US008240805B2

(12) United States Patent
Sarger et al.

(10) Patent No.: US 8,240,805 B2
(45) Date of Patent: Aug. 14, 2012

(54) SYSTEM FOR DETECTING OFFSET PRINTING USING SAME

(75) Inventors: Laurent Sarger, Talence (FR); Lionel Canioni, Gradignan (FR); Stéphane Santran, Pau (FR); Edouard Girault, Chatillon (FR)

(73) Assignees: Centre National de la Recherche Scientifique (CNRS), Paris (FR); Universite Bordeaux 1, Talence Cedex (FR)

( * ) Notice: Subject to any disclaimer, the term of this patent is extended or adjusted under 35 U.S.C. 154(b) by 891 days.

(21) Appl. No.: 11/883,402

(22) PCT Filed: Jan. 27, 2006

(86) PCT No.: PCT/FR2006/000193

§ 371 (c)(1),
(2), (4) Date: Nov. 4, 2008

(87) PCT Pub. No.: WO2006/082299

PCT Pub. Date: Aug. 10, 2006

(65) Prior Publication Data

US 2009/0213164 A1 Aug. 27, 2009

(30) Foreign Application Priority Data

Feb. 1, 2005 (FR) ..... 05 01001

(51) Int. Cl.
*B41J 29/393* (2006.01)
*B41J 2/435* (2006.01)

(52) U.S. Cl. ..... 347/19; 347/224

(58) Field of Classification Search ..... 347/19, 347/224

See application file for complete search history.

(56) References Cited

U.S. PATENT DOCUMENTS 5,223,918 A * 6/1993 Berthold et al. ..... 356/407
5,995,267 A * 11/1999 Paoli ..... 347/233

* cited by examiner

*Primary Examiner* — Matthew Luu
*Assistant Examiner* — Jannelle M Lebron
(74) *Attorney, Agent, or Firm* — Blakely, Sokoloff, Taylor & Zafman

(57) ABSTRACT

The invention concerns a detection system (7) for measuring at least one characteristic of an inked zone (5) comprising at least one sensor adapted to sense a light radiation reflected by said inked zone (5) and to generate a measurement signal representing at least the characteristic of the inked zone (5). Such a system further comprises at least one first optic fiber (10), adapted to convey up to the neighborhood of the inked zone (5), a light radiation emitted by a light source (11).

14 Claims, 2 Drawing Sheets

SYSTEM FOR DETECTING OFFSET PRINTING USING SAME

This is a non-provisional application claiming the benefit of International application number PCT/FR2006/000193 filed Jan. 27, 2006.

The invention concerns a detection system used to measure at least one characteristic of an inked zone, designed particularly for offset printing devices, and a machine using such a detection system.

The invention more particularly concerns a detection system to measure at least one characteristic of an inked zone created on a substrate by a printing device, where this system includes at least one sensor designed to capture light radiation reflected by the said inked zone, and to generate a signal representing at least the characteristic of the inked zone.

Such a detection system is already known in the printing trade, particularly in the area of offset printing. By offset is meant a printing method in which the inked image of an engraved metal plate is transferred onto a roller covered with a rubber sheet, which then prints onto the paper. In the case of colour offset printing, an operator has to regularly check the inks used, as they appear on an adjusting strip on the printing margin, in order to guard against colour variation in the inks. This colour variation, particularly regarding the hue and saturation of the inks, results in variations in the rendering of the printing method. As a consequence, the operator has to extract a printed copy by hand, and compare the adjusting strip with a model.

In order to perform this operation, it is common to use this type of detector. In fact, in order to correctly compare the shades and saturation levels of the inks, it is necessary to illuminate the adjusting strip by means of a standard white light source, such as a lamp whose light has a colour temperature of 5000 Kelvin, for example. However because of the colour-temperature disparities from one lamp to the next, and of the cost of this type of lamp, a single lamp is generally used for all of the comparisons. As a consequence, this stage is lengthy, and the control procedure does not allow this variation in the inks to be controlled in a satisfactory manner.

By hue is meant the sum of the wavelengths re-emitted by an ink when it receives a white light. Hue also indicates the rate of dilution of an ink.

The purpose of this present invention is particularly to overcome these drawbacks.

To this end, the invention proposes a detection system that allows automatic regulation of variations in the colours on an offset printing machine.

The invention also proposes a detection system that allows the variation in the colours of a printed document to be reduced at low cost.

To this end, according to the invention, a detection system of the type in question is characterised in that it also includes at least one first optical fibre, designed to convey light radiation emitted by a light source to the vicinity of the inked area.

By virtue of these arrangements, the detector is able to use a reference lamp that is remoted to the outside of the printing machine, and which is common to a collection of detectors, used on the same machine or even on different machines for example. Thus, for a cost close to that of the prior art, it is possible to effect an automatic, rapid and reliable comparison.

In various embodiments of the method of the invention, it is possible, where appropriate, to adopt any of the following arrangements:

the measured signal, representing the colour, includes a signal representing the colour which itself includes at least a part of the light radiation reflected by the inked zone;

the detection system also includes at least one second optical fibre to convey the said signal representing the colour from the vicinity of the inked zone;

the sensor includes a spectrophotometer;

the representative measured signal includes a signal representing the brightness of the inked zone and in which the second optical fibre is designed to convey, from the vicinity of the inked zone, the light radiation reflected by the inked zone;

the first optical fibre is designed to illuminate the inked zone at least at the vicinity of a point of incidence along a lighting axis, and the at least one sensor of the light radiation reflected by the said inked zone is positioned more-or-less on a reception axis, with the said reception axis being more-or-less symmetrical with the lighting axis, with an axial symmetry along a line passing through the said point of incidence, and orthogonal to the said inked zone;

the lighting axis and the reception axis are more-or-less orthogonal to the said inked zone;

the detection system also includes at least one second optical fibre designed to convey, from the vicinity of the inked zone, light radiation reflected by the inked zone, and in which the signal representing the brightness includes a signal representing the intensity of the reflected light radiation;

the sensor also includes at least one camera, and the signal representing the brightness is a signal representing the spatial extension and/or the intensity of the reflected light radiation;

the sensor includes digital processing means which are used to obtain, from an image acquired by the camera, the signal representing the brightness;

the detection system also includes:

at least one lighting device to illuminate the inked zone at least in the vicinity of a point of incidence on a lighting axis, and the at least one sensor of the light radiation reflected by the said inked zone is positioned more-or-less on a reception axis, where the said reception axis is more-or-less symmetrical with the lighting axis, with an axial symmetry along a line passing through the said point of incidence, and orthogonal to the said inked zone, and the at least one sensor is designed to generate a measured signal that is representative at least of the brightness of the inked zone;

the lighting device includes at least one laser diode to illuminate the said inked zone;

the sensor includes at least one camera in which the signal representing the brightness is a signal representing the spatial extension and/or the intensity of the reflected light radiation;

the detection system further includes at least one second optical fibre designed to convey the light radiation reflected by the inked zone from the vicinity of the inked zone, and the signal representing the brightness includes a signal representing the intensity of the reflected light radiation.

In addition, the invention also has as its subject a brightness detection system characterised in that it includes at least one lighting device to illuminate an inked zone at least in the vicinity of a point of incidence along a lighting axis, at least one sensor of light radiation reflected by the said inked zone, positioned more-or-less on a reception axis, the said reception axis being more-or-less symmetrical with the lighting axis, with an axial symmetry along a line passing through the said point of incidence, and orthogonal to the said inked zone, and the said at least one sensor is designed to generate a measured signal that is representative at least of the brightness of the inked zone.

Furthermore, the invention concerns a set of detection systems that includes a multiplicity of detection systems according to the invention, including a single light source, in which the light radiation conducted by all of the first optical fibres is supplied by the said single light source.

In addition, all of the sensors of the detection systems can include a common part.

Furthermore, another aspect of the invention concerns a machine designed to print on a substrate, characterised in that it includes:

- a printing device creating at least one inked zone on the said substrate, by means of at least one printing ink,
- a feedback loop to perform the regulation of at least one characteristic of an inked zone, where the said feedback loop includes:
  - at least one control unit, to control at least one characteristic of the said printing ink, in accordance with a difference between at least one characteristic of the control inked zone and at least one characteristic of the measured inked zone;
  - at least one detection system to measure at least one characteristic of an inked zone, where the detection system includes:
    - at least one sensor designed to capture light radiation reflected by the said inked zone, and to generate a signal representing at least the characteristic of the inked zone, and
    - at least one first optical fibre, designed to convey light radiation emitted by a light source to the vicinity of the inked area.

According to one method of implementation, the inked zone includes an adjusting strip for a printing system of the offset type, and the printer is a printer of the offset type. In addition, the characteristic of the control inked zone can be obtained from a test piece using the same detection system.

Next, the invention proposes an assembly of a multiplicity of machines for the purpose of printing, where the said assembly includes a single light source and the light radiation conducted by all of the first optical fibres of the detection systems is supplied by the said single light source.

Likewise, this assembly of a multiplicity of machines can share at least a part of the sensor of each detection system, or indeed a single control unit.

Other characteristics and advantages of the invention will appear from the description that follows of one of these methods of implementation, given by way of a non-limiting example, with reference to the attached drawings, in which.

In the different figures, the same references designate identical or similar elements.

Figure 1:
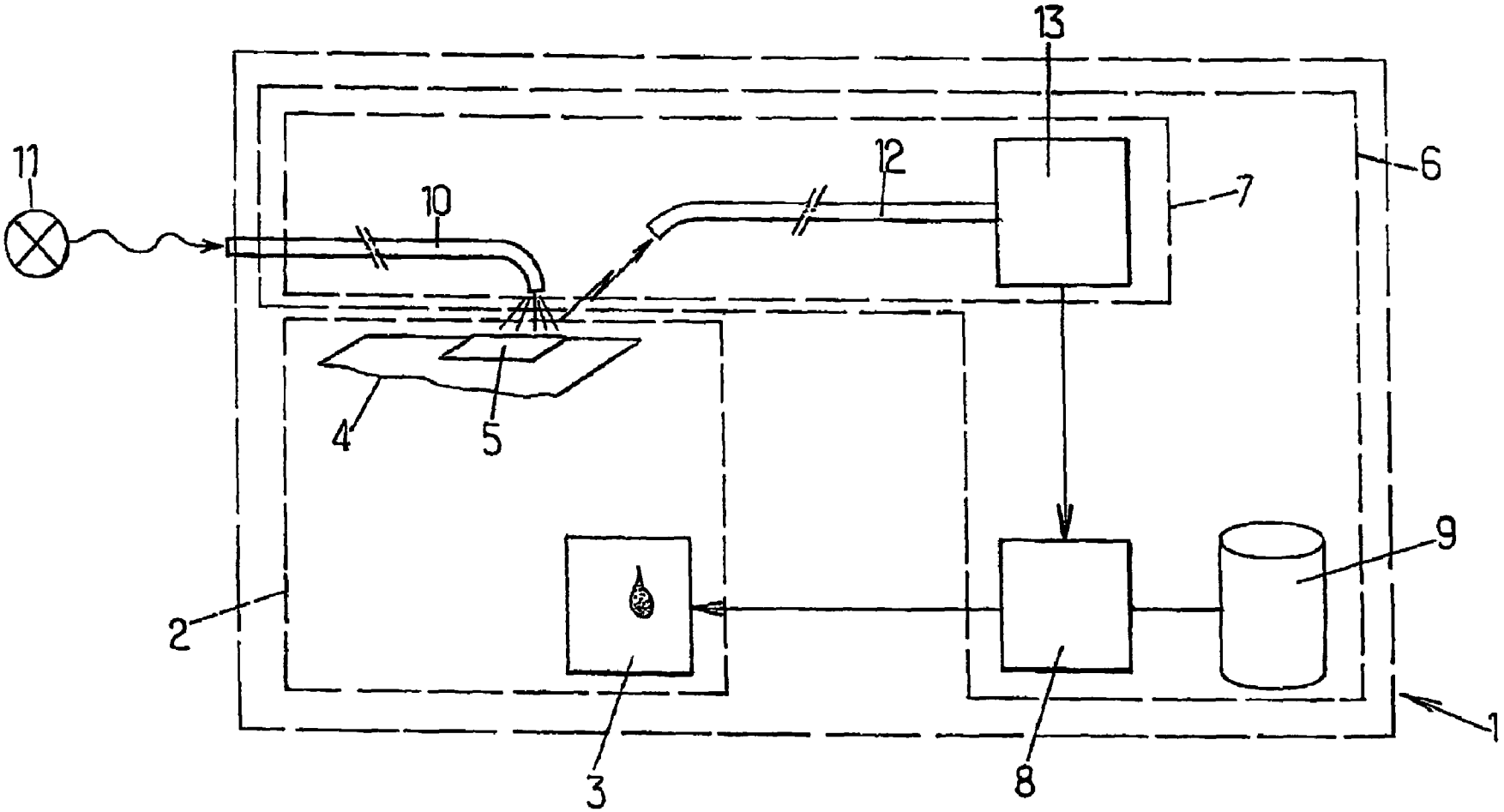
FIG. 1 represents a schematic view of a machine according to the invention.

As illustrated in FIG. 1, a printing machine 1 according to the invention can include a printing device 2. For example, in the case of a so-called offset printing device, the latter includes at least one ink source 3, meaning an ink store, generally in the form of wells containing liquid ink. The printing device 2 creates printed copies 4 on printing substrates such as paper. On the margin of each printed copy 4, there can appear an adjusting strip 5, created from the coloured inks used to perform the printing.

The machine 1 also includes a feedback loop 6 which is used to regulate any variation in the colours that can occur because of incorrect settings, or of maladjustment of the printing device 2. This feedback loop 6 thus acts directly on the inking system 3. In addition, this feedback loop includes a detection system 7 that detects a characteristic of the coloured zone comprising the adjusting strip 5, in this case the colour, and therefore the hue and the saturation for example. This detection system 7 supplies a control unit 8 with a signal representing at least one characteristic of the adjusting strip 5. This control unit 8 then compares this signal, representing a measured characteristic of the coloured zone, with a control characteristic of the coloured zone, as recorded in a computer memory 9 for example.

In fact, during the design process, a user can have chosen particular inks, and this machine structure 1 can be used to provide greater reliability of the rendering in terms of compliance with colour standards. Thus, the control characteristic can be obtained from a test piece which has been validated by a customer or a user, using the same detection system for example. A comparison is then performed which is not affected by error due to differences of characteristics in the measuring devices. This allows a printed article to be created which is even more faithful to the reference validated by the customer. It is thus possible to avoid the problem of a difference between the test piece validated by the customer and the final printed article.

In addition, all of the printing procedure, including the design of the printing process can be achieved from the same control unit. It is possible, for example, to use as a reference a test piece created from any medium, such as a computer file or a test piece created by an inkjet process.

In the case represented in FIG. 1, the detection system 7 is a characteristic detection system that can include a first optical fibre 10, used to convey the light emitted by a lamp 11 to the vicinity of the coloured zone formed by the adjusting strip 5, and thus to illuminate it. The lamp used is one whose colour temperature is 5000 Kelvin for example, used commonly in the printing trade. However, this lamp could be one with a colour temperature of 6500 Kelvin, which is close to daylight.

The light re-emitted by the coloured zone is then detected by a sensor, formed here for example from an optical fibre 12 connected to a measuring device such as a spectrophotometer 13. Thus, a part of the light re-emitted by the adjusting strip 5 is conducted to the spectrophotometer 13 via the optical fibre 12, and then the spectrophotometer 13 supplies the signal representing the measured colour to the control unit 8, to perform the regulation.

Thus, it is possible to supply a signal on the characteristic of the coloured zone, automatically and in real time, to a control unit 8 that performs regulation of the ink used.

According to an implementation variant (not shown), a second measurement optical fibre is used to supply to, a spectrophotometer 13, a part of the light that is re-emitted by a uncoloured zone, meaning a zone clear of any ink, in order for example to assess a colour characteristic of the printing substrate. Thus, the control unit 8 will take account of the colour of this substrate in order to adequately correct and regulate the colour characteristic of an ink used.

In addition, a second type of detection system can be used in order to determine another characteristic of the ink used, namely the brightness. By the brightness of an ink is meant the ability of an ink to disperse light radiation. Thus, a glossy ink disperses little and it is possible to observe a virtually focussed reflection of the light source. Conversely, a mat ink diffuses a lot of light, and it is possible to observe reflections of the light source at the surface of the coloured zone.

Figure 2:
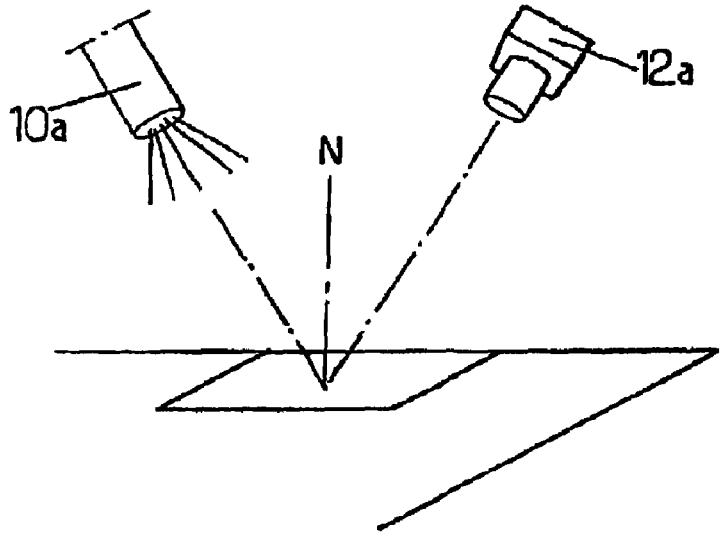
FIG. 2 represents a detector according to the invention.

Thus, as seen in FIG. 2, a light source 10*a* illuminates the coloured zone on a lighting axis. This lighting device can be an optical fibre as before, but also at least one laser diode, because in the case of the brightness, the colour of the lighting is not very important. Orientated on a reception axis that is symmetrical with the lighting axis in relation to a normal N at the surface of the coloured zone, a reception device 12*a* receives the light re-emitted by the coloured zone, and supplies, to a measuring device, a signal representing the brightness. The reception device can be an optical fibre 12*a*, and the measuring device can be a circuit that includes a photodiode, which delivers an electrical signal that is a function of the received light intensity. In this case, the aspect of the brightness measured is the reflected light intensity.

In another case, it is possible to use a camera as the reception device 12*a*, and the measuring device can be an image processing unit. In this case, it is possible to measure not only the light intensity reflected by the coloured zone, but also a specular aspect, meaning the spatial extension and the orientation of the reflection from of the coloured zone. Integrated into a machine 1, described previously, this detection system can be used to regulate the brightness of the ink employed by the machine 1.

In addition, the two detection systems can be combined in a single machine 1, as well as various other detection systems to check other aspects of the invention.

Figure 3:
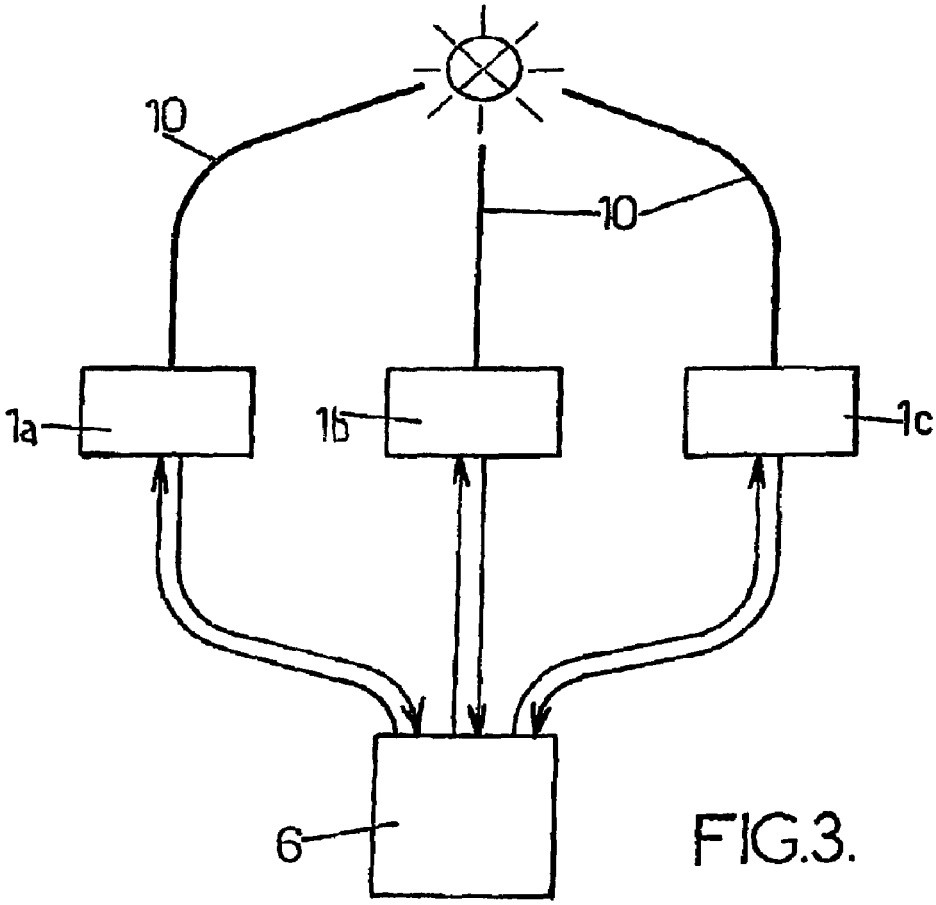
FIG. 3 shows a set of machines according to the invention.

According to an embodiment illustrated in FIG. 3, a multiplicity of machines 1*a*, 1*b*, 1*c*, which can be in conformity with the machine of FIG. 1, can be used simultaneously. Each of these machines uses a feedback loop to regulate a characteristic of the ink employed. In this case, a single lamp can be used, and the radiation from this lamp is conveyed by a network of optical fibres 10 to each of the machines 1*a*, 1*b* and 1*c*. This results in a significant saving in the number of lamps used, and in addition it is possible to remote the lamp in another room, such as one that is less subject to light interference for example.

Similarly, it is possible to centralise the devices in the feedback loops of the machines 1*a*, 1*b*, 1*c* in a single feedback loop 6. It is thus possible, for example, to employ a single spectrophotometer or a single control unit. As a consequence, the number of these costly assemblies can be reduced to one per printing plant. It is likewise possible to centralise these feedback loops for several plants, in different places. It is then possible to separate the production part from the design part. This makes it possible to perform remote regulation simultaneously on a multiplicity of machines.

The invention claimed is:

1. An assembly of a multiplicity of machines employed to perform a printing operation, where the said assembly has a single light source, with each machine including:

a printing device that creates at least one inked zone (5) on a printing substrate, by means of at least one printing ink, a feedback loop (6) to perform the regulation of at least one characteristic of said inked zone (5), the feedback loop acting directly on the printing device; wherein the feedback loop includes:

at least one control unit, to control at least one characteristic of the said printing ink, in accordance with a difference between at least one characteristic of a control inked zone (5) and at least one characteristic of a measured inked zone (5);

at least one detection system (7) to measure at least one characteristic of said inked zone (5), where the detection system (7) includes: at least one sensor designed to capture light radiation reflected by the said inked zone (5), and to generate a signal representing at least the characteristic of the inked zone (5), and at least one first optical fibre (10), designed to convey, to the vicinity of the inked zone (5), light radiation emitted by the said single light source.

2. An assembly of machines according to claim 1, in which a part of each sensor is common to all of the machines.

3. An assembly of machines according to claim 1, in which the measured signal representing the characteristic of the inked zone includes a signal representing the colour, which itself includes at least a part of the light radiation reflected by the inked zone (5).

4. An assembly of machines according to claim 1, in which the detection system of each machine also includes at least one second optical fibre (12) to convey the said signal representing the colour of the inked zone (5) from the vicinity of the inked zone.

5. An assembly of machines according to claim 1, in which the sensor includes a spectrophotometer (13).

6. An assembly of machines according to claim 1, in which the inked zone (5) includes a printed copy and an adjusting strip for an offset type printing process, the adjusting strip being located on a margin of the printed copy, and in which the printing device is a printer of the offset type.

7. An assembly of machines according to either of claim 1 or 6, in which the characteristic of the control inked zone is obtained from a test piece by means of the said detection system (7).

8. An assembly of machines according to claim 1, including a single control unit shared by all of the feedback loops (6) of the said machines.

9. An assembly of machines according to claim 8, that also includes at least one second optical fibre (12) designed to convey, from the vicinity of the inked zone (5), light radiation reflected by the inked zone (5), and in which the signal representing the brightness includes a signal representing the intensity of the reflected light radiation.

10. An assembly of machines according to claim 1, in which the measured signal representing the characteristic of the inked zone includes a signal representing the brightness of the inked zone (5), where the detection system has at least one second optical fibre (12) designed to convey from the vicinity of the inked zone (5), light radiation reflected by the inked zone (5).

11. An assembly of machines according to claim 10, in which the first optical fibre (10) is designed to illuminate the inked zone (5) at least to the vicinity of a point of incidence on a lighting axis, and in which the at least one sensor of light radiation reflected by the said inked zone (5) is positioned more-or-less on a reception axis, with the said reception axis being more-or-less symmetrical with the lighting axis, with an axial symmetry along a straight line N passing through the said point of incidence, and orthogonal to the said inked zone (5).

12. An assembly of machines according to claim 11, in which the lighting axis and the reception axis are more-or-less orthogonal to the said inked zone (5).

13. An assembly of machines according to claim 1, in which the sensor also includes at least one camera (12*a*) and in which the signal representing the brightness is a signal representing the spatial extension and/or the intensity of the reflected light radiation.

14. An assembly of machines according to claim 13, in which the sensor includes digital processing means to obtain the signal representing the brightness, from an image acquired by the camera.

* * * * *